US006601330B2

(12) United States Patent
Dusink

(10) Patent No.: US 6,601,330 B2
(45) Date of Patent: Aug. 5, 2003

(54) FRAME MEMBER

(75) Inventor: Henricus Niklaas Josephus Dusink, Zwolle (NL)

(73) Assignee: Weltec B.V., Kampen (NL)

( * ) Notice: Subject to any disclaimer, the term of this patent is extended or adjusted under 35 U.S.C. 154(b) by 0 days.

(21) Appl. No.: 09/921,745

(22) Filed: Aug. 3, 2001

(65) Prior Publication Data

US 2002/0020096 A1 Feb. 21, 2002

Related U.S. Application Data

(63) Continuation of application No. PCT/NL00/00064, filed on Feb. 2, 2000.

(30) Foreign Application Priority Data

Feb. 3, 1999 (NL) ..... 1011209
Jul. 23, 1999 (NL) ..... 1012684

(51) Int. Cl.[7] ..... A47G 1/06
(52) U.S. Cl. ..... 40/792; 40/791
(58) Field of Search ..... 40/611, 790, 791, 40/792, 793, 794, 156, 658, 666; 24/487, 543

(56) References Cited

U.S. PATENT DOCUMENTS

| | | | | |
|---|---|---|---|---|
| 4,364,192 | A | 12/1982 | Lloyd | 40/791 |
| 4,523,400 | A | 6/1985 | Seely | 40/791 |
| 4,877,213 | A | 10/1989 | Lambert | 40/783 X |
| 4,998,363 | A | 3/1991 | Vilims | 40/792 |
| 5,042,180 | A | 8/1991 | Horiuchi | 40/791 |
| 5,279,056 | A | 1/1994 | Komamura | 40/782 X |

FOREIGN PATENT DOCUMENTS

| | | |
|---|---|---|
| DE | 295 02 115.2 | 4/1995 |
| EP | 0 375 237 A2 | 6/1990 |
| FR | 2 667 968 A1 | 4/1992 |
| FR | 2 322 572 | 4/1997 |
| GB | 2 010 673 A | 7/1979 |
| HU | 190 332 | 11/1984 |

OTHER PUBLICATIONS

PCT/ISA/210 Int'l Search Report.
PCT/ISA/201(a) Netherlands Search Report (with English Translation).

*Primary Examiner*—Brian K. Green
(74) *Attorney, Agent, or Firm*—Troutman Sanders LLP; Ryan A. Schneider, Esq.

(57) ABSTRACT

Picture frame member comprising a first support flange for an edge portion of a picture and a second flange which encloses a dihedral angle with the first flange to laterally hold the edge portion, the second flange being pivotally connected—adjacent its end turned away from the first flange—a press strip which is movable from an inoperative position outside the dihedral angle towards an operative position within the dihedral angle. The second flange is in the form of a rectangular box, where the outer upstanding wall is extended—in a direction turned away from the first flange—by a flange portion that has its free longitudinal edge connected to the press strip. The press strip is provided with a snap engagement that engages—in the operative press position of the press strip—a complementary snap engagement on the inner side of the flange portion.

5 Claims, 2 Drawing Sheets

FRAME MEMBER

CROSS REFERENCE TO RELATED APPLICATIONS

This is a continuation application of PCT/NL00/00064 filed on Feb. 2, 2000, itself having priority back to NL1011209, filed Feb. 3, 1999 and NL1012684, filed Jul. 23, 1999.

BACKGROUND OF THE INVENTION

1. Field of the Invention

The present invention is in the field of framing pictures, posters and the like.

To hold a picture, poster or similar image carrier a substantially rectangular frame is composed from four identically shaped frame members which are mitred to the desired length and connected to one another to form the four sides of the frame. The frame is put with its front side turned downwardly onto a support base. Then the image carrier to be framed—mostly fitted between a glass plate and a back plate of e.g. paper board or hard board—is placed with the glass plate turned downwardly into rebates of the four frame members. This manner of framing, according to which a frame is composed first before placing the image carrier, is called "back loading" and is to be distinguished from the manner of framing, which is called "side loading" whereby four mitred U-type frame members are placed from aside about the edges of the image carrier to be framed.

More particularly the present invention relates to a frame member adapted to make frames for pictures, posters or similar image carriers from it, which frame member comprises

- a first flange to serve as a support flange for an edge portion of the image carrier to be framed;
- a second flange that encloses a dihedral angle with said first flange and is adapted to capture said edge portion laterally;
- a press strip which is hingedly connected to said second strip at a location which is spaced from said first flange, such that
  - the said strip may be moved from an imperative position outside said dihedral angle to an operative position in which the said strip extends obliquely into the dihedral angle to contact the image carrier to be framed and press the same onto said first flange.

2. Prior Art

A frame member of the type above referred to is disclosed in European patent EP 0 375 237 (see the embodiment of FIGS. 3 and 4 in particular). With this well-known frame member a press strip is connected through a "film hinge" to the free end of the second flange and is thus formed in one piece wit the two flanges of the frame member. The advantage of this type of frame member is that no separate means such as clamps are required to fix the image carrier in place.

In the European patent EP 0 375 237, however, the frame member is shown rather diagrammatically and both the first flange and the second flange are illustrated as solid parts, whereas the press strip is in fact an extension of the second flange that gradually decreases in thickness and is separated from the proper second flange by a longitudinal cut that extends from the outer side of the second flange through almost the entire thickness of the second flange.

The patent does not disclose how the required pressing force for fixing the image carrier in place can be realized with the press strip.

3. Object and Summary of the Invention

It is therefore an object of the present invention to work out and improve the well-known frame member through simple means and come to a practically applicable frame member, which is adapted to be used for framing pictures and the like according to the "back loading" mode.

According to the teachings of the present invention there is provided a frame member of the general type indicated hereinbefore, which is characterized in that said second flange is in the form of a rectangular box section of which an outer upstanding wall is extended—in a direction turned away from said first flange—by a flange portion that has its free end connected to said press strip, and further characterized in that said press strip is provided with a snap enagement means that engages—in the operative press position of the press strip—a complementary snap engagement means on the inner side of said flange portion.

In this connection it is to be remarked that forming a flange of an angled frame member as a hollow box section, which allows two adjacent frame members to be coupled by means of an angled connecting member of which the two legs are each inserted in the hollow box section of each of the two frame members, is known per se with another type of well-known frame member, that does not have a press strip and requires separate clamp means to fix the image carrier in place.

As distinguished from the well-known frame member above referred to, with which the press strip is connected to the second flange by means of a film hinge provided on the inner side, the hinge connection between the press strip and the second flange with the frame member of the present invention is provided on the outer side, whereas on the inner side of the flange portion (press strip) that now is an extension of the outer wall of the box section, a space has been created in which the snap/holding means of the invention may be received without thereby interfering with the placing of an image carrier within a frame composed from the frame member of the present invention.

The frame member of the present invention is very user's friendly and of a compact design, so that a picture frame composed of the frame member of the present invention has a high degree of rigidity, with only a slight chance of yielding mitre joints. The frame member of the invention is adapted to be formed of one piece of plastic material, e.g. by extrusion.

Further features of the invention will be hereinafter further explained by two examples with reference to the accompanying drawing.

BRIEF DESCRIPTION OF THE DRAWINGS

With reference to FIGS. 1–3 the frame member shown therein is formed in one piece of a suitable plastic material. It has a first, hollow flange 1 with a convex outer or front side. Furthermore the frame member has a second flange 2 connected at right angles to the first flange 1 and formed as a rectangular box section, of which the inner upstanding wall 2*a* and the outer upstanding wall 2*b* are extended in a direction turned away from the first flange 1 by a projecting longitudinal edge 2" and a flange portion 2' respectively. The free longitudinal edge of the flange portion 2' is connected with a press strip 4 by means of a film hinge 3 or a similar flexible connecting portion. The press strip 4 has a first strip portion 4*a*, which is connected to the flange portion 2' through the film hinge 3 and may function as a finger grip. 4*b* is a transverse portion that extends from the strip portion 4*a* at some distance from the hinge 3. The end of the transverse portion 4*b* turned away from the strip portion 4*a* bends into a thickened edge 4*c* which may function as a snap rib. From the transverse portion 4*b* a second strip portion 4*d* extends with a gradually decreasing thickness towards its free longitudinal end, said second strip portion 4*d* taking a diverging position relative to said first strip portion 4*a*, as seen from the hinge 3.

Two lips of leg portions 5 and 6 respectively extend from the inner side of the flange portion 2'. The slightly obliquely oriented lip 5 defines, together with the box section wall 2*c* and the longitudinal edge 2', a snap space 7 adapted to cooperate with the snap rib 4*c*.

Figure 1:
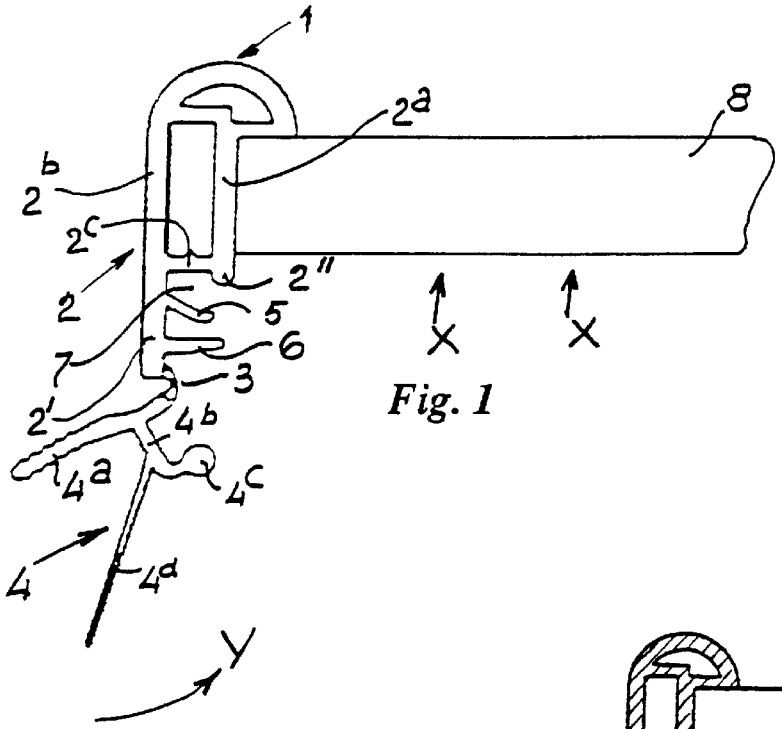
FIG. 1 is a cross-sectional view, on an enlarged scale, of the frame member of the present invention, in a first embodiment, with the press element in the inoperative position.
Figure 3:
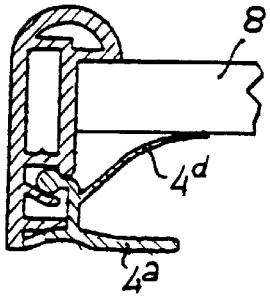
FIG. 3 is a cross-sectional view, wherein the press strip of the frame member of FIGS. 1–2 locks an image carrier to be framed in place relative to the frame member.
Figure 2:
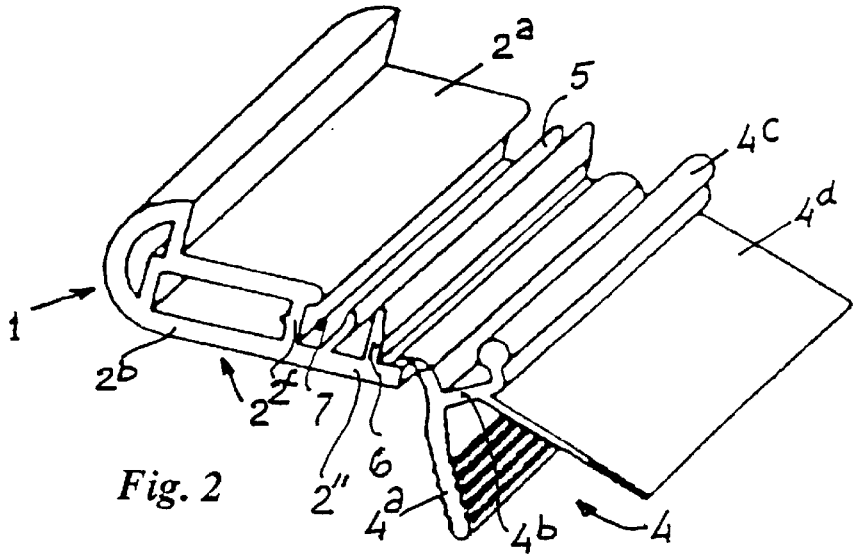
FIG. 2 is a perspective view of a piece of frame member of FIG. 1, also with the press strip swung outwardly into the inoperative position.

The frame member is preferably extruded with the press strip 4 in its outwardly swung position as shown in FIG. 1 and 2. In that position the image carrier unit 8 (=glass plate, image carrier and rear support plate) to be framed may be simply placed in the arrow direction X.

Upon the image carrier unit 8 being placed the press strip 4 is swung inwardly according to arrow Y, which brings the second strip portion 4*d* in a position in which it engages the rear side of the image carrier unit such that the strip portion 4*d* will apply a uniform pressure along the entire length of the respective picture frame side. Depending on the thickness of the image carrier unit the second strip portion 4*d* will bend more or less towards the first strip portion 4*a*. In the final phase of the inwardly swinging motion of the press strip 4 the snap rib 4*c* will enter into the snap space 7, which locks the press strip 4 in its operative press position. In this position the part of the first strip portion 4*a* that is located adjacent the hinge 3, is engaging the abutment lip 6, substantially in the plane of the free longitudinal edge of the flange portion 2', parallel to the first flange 1.

Conversely the press strip 4 may be simply swung from its operative position outwardly, while the first strip portion 4*a* is functioning as a finger grip.

Figure 4:
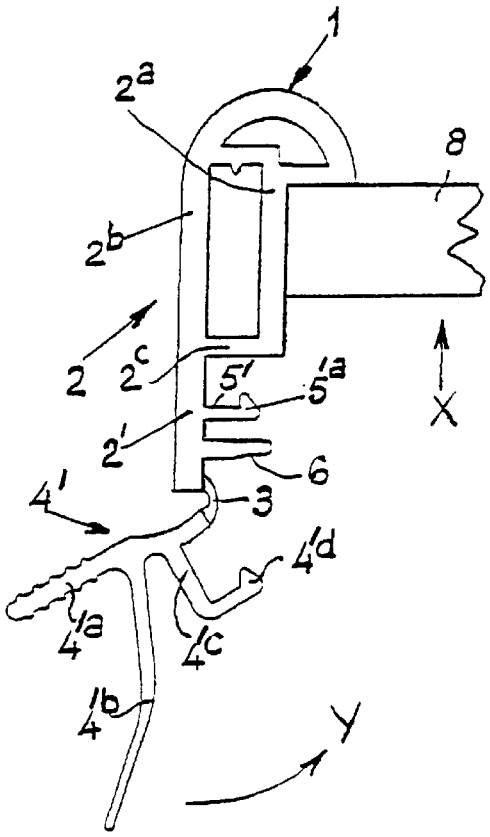
FIG. 4 shows an end view on an enlarged scale of the frame member of the invention in a second embodiment, with the press strip in the inoperative position.
Figure 5:
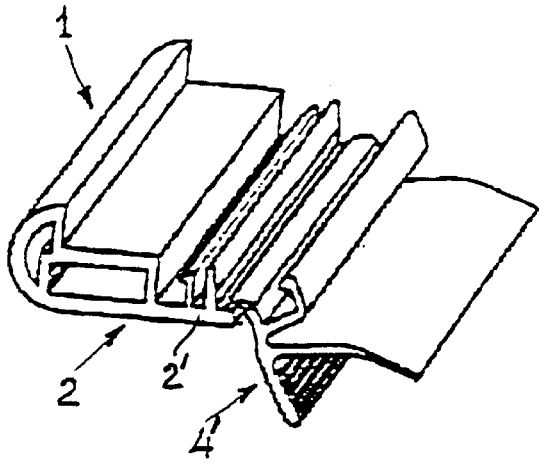
FIG. 5 is a perspective view of a piece of frame member of FIG. 4, also with the press strip in the outward, inoperative position
Figure 6:
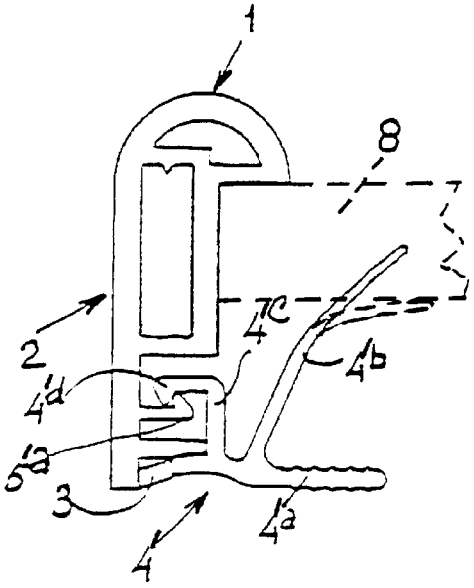
FIG. 6 is an end view similar to FIG. 4, wherein the press strip locks an image carrier to be framed in place relative to the frame member.

In the second embodiment according to FIGS. 4–6 the frame member is also integrally formed of a suitable plastic material. It has a first, hollow flange 1 with a convex outer or front side. Furthermore the frame member has a second flange 2 connected at right angles to the first flange 1 and formed as a rectangular box section, of which the outer upstanding wall 2*b* is extended, in a direction turned away from the first flange 1, to form a single walled flange portion 2'. The free longitudinal edge of the flange portion 2' is connected to a press strip 4' through a film hinge 3 or a similar flexible connecting portion. At a slight distance form the hinge 3 the press strip 4' branches into a first strip portion 4'*a*, which may serve as a finger grip, and a second strip portion 4'*b*, which is the proper press strip and has a thickness, that gradually decreases towards its free end, so that its flexibility is gradually increasing.

Just short of the branching there is a transverse portion 4'*c*, that extends from the press strip 4'. At some distance from the strip 4' the transverse portion 4'*c* bends at right angles and thus parallel to the strip 4' to end into a hook portion 4'*d* of a isosceles triangle-shaped cross section.

Two leg portions 5' and 6 respectively extend at right angles from the inne side of the flange portion 2'. The leg portion Sends in a right angled triangle-shaped hook portion 5'*a*, that cooperates with the hook portion 4'*d* to lock the press strip 4' in its operative press position. The leg portion 6 may thereby function as an abutment.

The frame member is preferably extruded with the press strip 4' in its outwardly swung position as shown in FIG. 4 and 5. In that position the image carrier unit 8 (=glass plate, image carrier and rear support plate) to be framed may be simply placed in the arrow direction X.

Upon the image carrier unit 8 being placed the press strip 4' is swung inwardly according to arrow Y, which brings the second strip portion 4'*b* in a position in which it engages the rear side of the image carrier unit such that the strip portion 4*d* will apply a uniform pressure along the entire length of the respective picture frame side. Depending on the thickness of the image carrier unit the tapering end of the press strip portion 4'*b* will bend more or less towards the first strip portion 4'*a*.

In the final phase of the swinging movement of the press strip 4' the hook portion 4'*d* will initially run—while the leg portion 5' and/or the transverse portion 4'*c* is yielding—onto the oblique end face of the hook portion 5'*a* and finally click behind the hook portion 5'*a*. The strip 4' is thereby firmly locked in its operative press position.

The portion of the strip 4', that it immediately adjacent the hinge 3 will thereby engage the abutment leg portion 6 and oriented substantially in the plane of the free longitudinal edge of the flange portion 2', parallel to the first flange 1.

It is relatively easy to lock the press strip 4' in its operative position, viz. by applying a small (press) force. However, a release of the locked press strip—although possible—is much more difficult. For that purpose the right angled transverse portion 4'*c* must bend, as seen in FIG. 6, to the right in order to allow the triangle-shaped hook portion 4'*d* to run with its inner oblique face over and off the top of the hook portion 5*a*. It will be understood, that such a bending movement can not be easily obtained by applying a pulling force (directed away from the flange 1) onto the strip portion 4'*a*; on the contrary a moment would have to be applied about the foot of the transverse portion 4'*c*.

Thus a hardly releasible snap connection is obtained, which ensures a reliable hold of the image carrier unit to be framed.

In both of the examples the composition of a picture frame from four mitred sections of the frame member of the invention may be effected in a well-known member, i.e. by making use of right angled corner connecting members, the legs of which are received within the box section spaces of the flanges 2 of each two adjacent frame members.

What is claimed is:

1. A frame member for an image carrier comprising:

a first flange to serve as a support flange for an edge portion of the image carrier;

a second flange that defines a dihedral angle with said first flange and which is adapted to capture said edge portion laterally; and a press strip which is hingedly connected to the second flange at a distance from the first flange by a flexible connection portion, such that the press strip may be moved from an inoperative position which allows the image carrier passing along the press strip to be captured in the dihedral angle towards an operative position closer to the dihedral angle in which the press strip extends obliquely in the dihedral angle to contact the image carrier while pressing against the image carrier towards the first flange;

wherein the second flange is in the form of a rectangular box section of which an outer upstanding wall is extended, in a direction from the first flange, by a second flange portion of the second flange, with the second flange portion having a free end connected to the press strip, and the press strip is provided with a snap engagement means which, in the operative position of the press strip, engages a complementary snap engagement means provided at an opposing inner side of the second flange portion, the press strip comprising a first strip portion and a second strip portion, the first and second strip portions converging towards the flexible connection portion, such that the first strip portion may be used as a finger grip and the second strip portion may press against the image carrier if the image carrier is captured in the dihedral angle, the press strip further comprising a transverse strip portion which extends transverse to the first strip portion at a side of the first strip portion opposite the second strip portion, with an end portion of the transverse strip portion being bent towards the first flange and being provided with the snap engagement means.

2. A frame member according to claim 1 wherein the snap engaging means is defined by a widening of the end portion of the transverse strip portion to therewith form a snap rib, which, in the operative position of the press strip, cooperates with a lip or leg portion extending from the inner side of the second flange portion, the lip or leg portion defining, together with an adjacent wall portion of the rectangular box section, a snap receiving space for the snap rib.

3. A frame member according to claim 1, wherein the snap engaging means is defined by the end portion of the transverse strip portion being hook shaped and forming a hook portion, which, in the operative position of the press strip, cooperates with a complementary hook portion provided at the end of a leg portion that extends from the inner side of the second flange portion.

4. A frame member according to claim 1, further comprising a second leg portion extending from the second flange portion which functions as an abutment for the press strip when the press strip is in the operative position.

5. A frame member according to claim 1, the second strip portion having a thickness which decreases towards a free end.

* * * * *